US010316620B2

(12) United States Patent
Pabon

(10) Patent No.: US 10,316,620 B2
(45) Date of Patent: Jun. 11, 2019

(54) DART AND SLEEVE MECHANISM FOR MULTIPLE ZONE ACTUATION

(71) Applicant: SCHLUMBERGER TECHNOLOGY CORPORATION, Sugar Land, TX (US)

(72) Inventor: Jahir Pabon, Newton, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 21 days.

(21) Appl. No.: 15/428,930

(22) Filed: Feb. 9, 2017

(65) Prior Publication Data

US 2018/0223627 A1 Aug. 9, 2018

(51) Int. Cl.

| | |
|---|---|
| ***E21B 34/10*** | (2006.01) |
| ***E21B 34/12*** | (2006.01) |
| ***E21B 34/14*** | (2006.01) |
| *E21B 34/00* | (2006.01) |

(52) U.S. Cl.
CPC ..... *E21B 34/14* (2013.01); *E21B 2034/007* (2013.01)

(58) Field of Classification Search
CPC ..... E21B 34/10; E21B 34/12; E21B 43/14; E21B 43/26; E21B 2034/007
See application file for complete search history.

(56) References Cited

U.S. PATENT DOCUMENTS

2013/0056220 A1* 3/2013 Sommers ..... E21B 34/102 166/373
2014/0060830 A1* 3/2014 Love ..... E21B 43/103 166/280.1
2014/0299319 A1* 10/2014 Pabon ..... E21B 34/14 166/285
2015/0000935 A1 1/2015 Pabon et al.
2016/0032684 A1* 2/2016 Shkurti ..... E21B 23/04 166/64

FOREIGN PATENT DOCUMENTS

| | | | |
|---|---|---|---|
| WO | WO2010129678 | A2 | 11/2010 |
| WO | WO2014043806 | A1 | 3/2014 |
| WO | WO2015149169 | A1 | 10/2015 |

OTHER PUBLICATIONS

International Search Report and Written Opinion of International Patent Application No. PCT/US2018/016947 dated May 31, 2018 (9 pages).

* cited by examiner

*Primary Examiner* — D. Andrews
*Assistant Examiner* — Yanick A Akaragwe

(57) ABSTRACT

A system for selectively actuating sliding valves includes a segmented sleeve exhibiting a rocking (or pivoting) function. The rocking allows the bottom end of the sleeve to open wider when the front of a dart is pressed against it, provided the length of the dart is shorter than a "target length" determined by the sleeve geometry. When the dart is at least as long as the "target length" of the sleeve, the back of the dart prevents the sleeve from rocking as the front of the dart is pressed against the bottom seat. The dart remains pressed against the sleeve, effectively isolating the wellbore section above the dart from the one below it. Multiple zones can thus be independently isolated by using a set of sleeves with similar diameters, but different "target lengths."

16 Claims, 8 Drawing Sheets

DART AND SLEEVE MECHANISM FOR MULTIPLE ZONE ACTUATION

FIELD

The subject disclosure generally relates to the field of devices in wellbores within subterranean rock formations. More particularly, the subject disclosure relates to techniques for actuation of downhole devices such as valves in wellbores.

BACKGROUND

There are many situations when it would be desirable to selectively activate multiple downhole devices. It is also preferable that one can do so not necessarily following a particular pre-determined sequence.

Typically there are multiple casing valves, each with a sliding sleeve and cemented in a well. Due to the heterogeneous nature of formation, one might not want to open all the valves simultaneously so that the fracturing operations can be performed separately for different layers of formations. A known method of selective actuation is to use different diameter balls to open the valves from bottom up. For example, each valve can have a restriction that will be blocked, or engaged, by a ball having a diameter at least as large as the restriction. The restrictions are then ordered so that the narrowest constriction is at the bottom, and the restriction size gradually is increased from the bottom up. A ball with smallest size is first dropped into the well. The size of the ball is designed so that it will go through all the valves except the bottom valve. The ball will be stopped by the bottom valve so that the sliding sleeve of the bottom valve will be pushed to the "open" position and expose the wellbore to cemented formation. Then the fracturing operation through the valve N can be executed. After that, the next size of ball will be dropped to activate the N−1 valve.

While the graduated ball technique works, it has an inherent limitation based on how many stages can be implemented in a string of valves downhole. Since the order of opening of the valves depends on the sizes of balls dropped, the radius of restriction in each stage needs to be different. Additionally, for a given size of the completion, the number of different sizes (radii) of restrictions is finite and is often less than desirable. Typically, a maximum of eight balls can be dropped, and this can severely impact the effectiveness of the multistage fracturing operation. For example, it is not uncommon to make wells economical that have 20 or more production zones.

Another known technique utilizes control lines between adjacent zones to activate restrictions. Once a restriction in a particular valve is activated, it is ready to catch a dart dropped from the surface in order to open this particular valve. However, there is a possibility for damage of the control lines during run-in-hole, especially in horizontal wells. A damaged control line might result in only those zones below the damaged zone being capable of production. Another drawback of this technique is that as the thickness of the valve increases, the internal diameter of the valve decreases in order to accommodate the complex hydraulic mechanisms in the valve.

Yet another known technique is described in commonly-owned U.S. Pat. Publ. No. 2015/0000935. This technique uses darts having moveable pieces that allow the dart to radially compress when engaging restrictions. However, since the darts have moveable pieces, during operation various portions of each dart piece are put under stresses and strains. As a result, a careful selection of material or materials should be made for the dart pieces.

Yet another known technique is described in commonly-owned U.S. Pat. Publ. No. 2014/0299319. This technique uses casing segments having a plurality of casing ribs. A sleeve member includes rocker members that are engaged by darts pumped through the well. Each dart that engages the rocking members causes the sleeve to move one rib position.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a system is described for selectively actuating a plurality of devices positioned in a well. The system includes: a conduit, a plurality of devices with assemblies, and a plurality of untethered objects. The conduit is configured to be positioned within the well. The devices are disposed along the conduit such that a fluid passageway extends through each of the devices. Each device includes at least one assembly. Each of the assemblies includes: an assembly outer sleeve having on its inner surface a fulcrum and an indentation; and a plurality of rocking sleeve members circumferentially arranged within the outer sleeve such that the passageway extends through the sleeve members and axial movement of the sleeve members is constrained. Each sleeve member has an outer surface dimensioned and shaped to pivot on the fulcrum and to partially fit into the indentation when rocked toward the indentation. The untethered objects are configured to be communicated through the passageway. Each object is shaped and dimensioned so that it can either pass or be trapped by an assembly. The object is trapped by an assembly when its characteristic length and characteristic diameter prevent sufficient rocking action by the rocking sleeve members that would allow the object to pass the assembly. The devices are configured for actuation when an object is trapped by an included assembly. The device actuation is caused by a fluid pressure differential between the upper and lower sides of the trapped object.

According to some embodiments, each rocking sleeve member has first and second inwardly protruding portions, and the characteristic length for each object is a length of a portion of the object that has a maximum diameter. The object can be trapped by an assembly when its characteristic length is at least as long as a distance between the first and second inwardly protruding portions of the rocking sleeves of the assembly. According to some embodiments, each untethered object is a solid dart having a front portion shaped as a surface of revolution (for example spherical or conical), a cylindrical middle portion and tapered rear section. The second inwardly protruding portions of the rocking sleeve members are shaped to match the shape of the front portions, and the characteristic length for each dart is equal to a length of the cylindrical middle portion of each dart. According to some embodiments, when a dart is trapped by an assembly, engagement of the front portion of the dart with the second inwardly protruding portions of the rocking sleeve members forms a seal that facilitates the fluid pressure differential.

According to some embodiments, the conduit is a casing and the devices are sliding casing valves each including an outer sleeve having at least one opening and an inner sleeve.

The inner and outer sleeves form a valve between the fluid pathway and an annular region outside of the casing. The valve is opened when openings on the outer sleeves are not obstructed by the inner sleeve due to sliding of the inner sleeve relative to the outer sleeve. According to some embodiments, the well penetrates a subterranean rock formation, such as a hydrocarbon-bearing formation, having a plurality of zones to be stimulated. The casing valves are normally closed, and the casing valves are positionable in the well with at least one casing valve in each zone such that each zone can be selectively stimulated by communicating an object that is configured to be trapped by an assembly of the casing valve in the zone and the fluid pressure differential causes the inner sleeve to slide relative to the outer sleeve so as to open the valve. The object (e.g. dart) can be made of a degradable material which is configured to dissolve in the wellbore environment after having been used to selectively actuate a device.

According to some embodiments, a method is described for selectively actuating devices in a well. The method includes installing a conduit in the well and pumping an untethered object through the well that becomes trapped and actuates a target device. The conduit installed in the well has a plurality of devices disposed thereon such that a fluid passageway extends through the conduit and through each device. Each device includes one or more assemblies. Each assembly includes an outer sleeve having on its inner surface a fulcrum and an indentation, and a plurality of rocking sleeve members circumferentially arranged within the outer sleeve such that the fluid passage extends therethrough. Each sleeve member has an outer surface dimensioned and shaped to pivot on the fulcrum and to partially fit into the indentation when rocked toward the indentation. The untethered object is selected and pumped through the passageway. The object is shaped and dimensioned to pass through certain assemblies and to be trapped by a target assembly that has sleeve members that are prevented from rocking by the object due to a characteristic length and a characteristic diameter of the object. The object is trapped by the target assembly, which is included in a target device. The target device is actuated using force from the fluid pressure differential created by the object being trapped in the assembly.

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the examples of the subject disclosure only, and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements. As used herein, the terms and phrases "deviated section or portion of the well", "deviated section or portion", "horizontal section or portion of the well", and "horizontal section or portion" are used interchangeably to indicate the section of the well that departs from the vertical wellbore.

According to some embodiments, a new sleeve and dart design is combined with a segmented sleeve that exhibits a rocking (or pivoting) function. The rocking function of the sleeve segments allows the bottom end of the sleeve to open wider when the front of a dart is pressed against it, provided the length of the dart is shorter than a "target length" determined by the sleeve geometry. When the dart is at least as long as the "target length" of the sleeve, the back of the dart prevents the sleeve from rocking as the front of the dart is pressed against the bottom seat. The dart remains pressed against the sleeve, effectively isolating the wellbore section above the dart from the one below it. Multiple zones can thus be independently isolated by using a set of sleeves with similar diameter, but different "target lengths". Additionally, sleeves and darts of different diameters (smaller towards the bottom of the well) can also be used. By using both dart length and dart diameter, rather than having a one-dimensional sequence of increasing radii (as in the known ball-restriction technique), we have a two-dimensional set of possible configurations. This greatly enhances the number of stages that could be isolated in a multi-stage fracturing operation; particularly because in contrast with the radial dimension, which is constrained by the well diameter, there is much more freedom along the axial direction.

Figure 1:
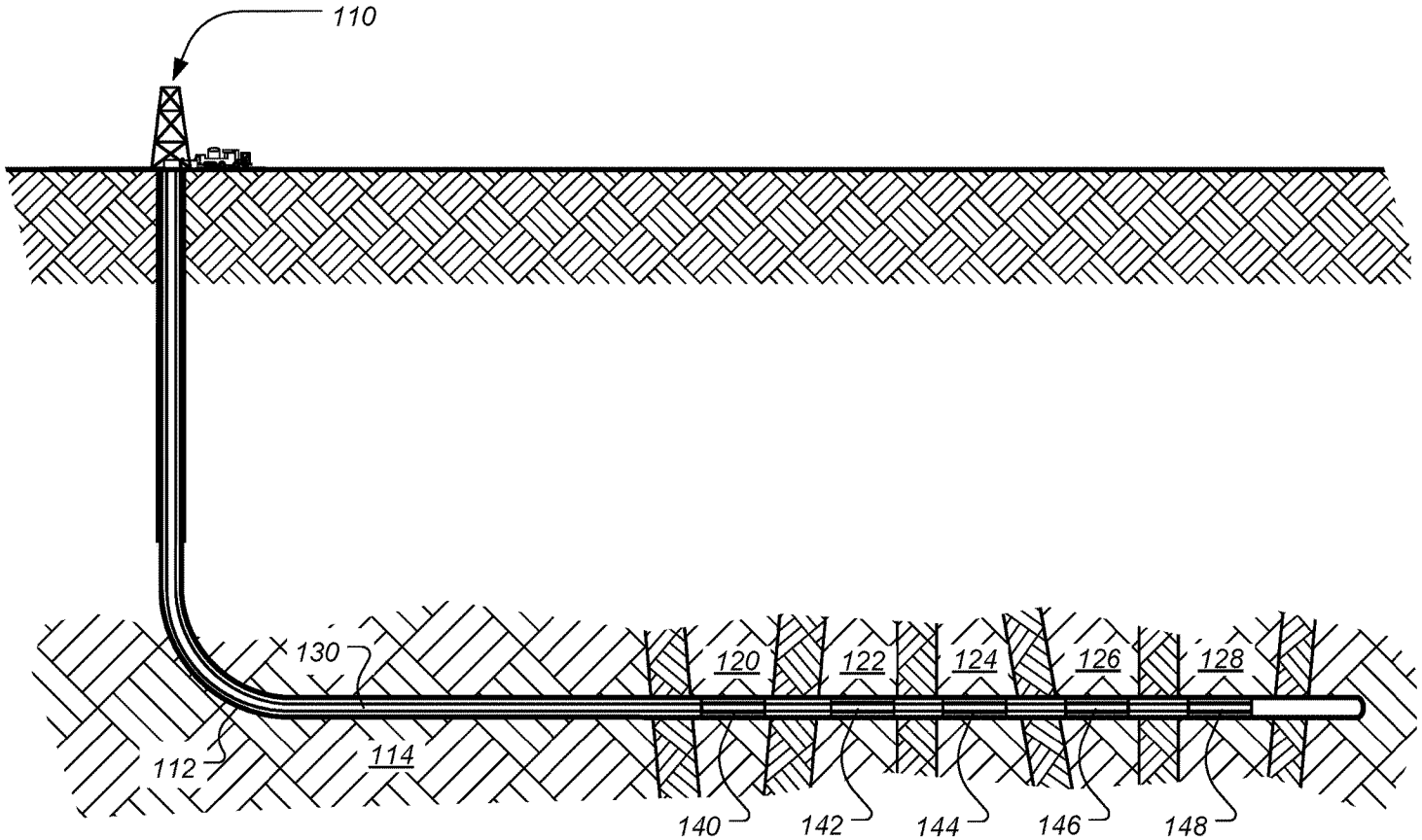
FIG. 1 is a diagram illustrating a wellbore penetrating a rock formation in which multiple zones are to be independently stimulated, according to some embodiments.

FIG. 1 is a diagram illustrating a wellbore penetrating a rock formation in which multiple zones are to be independently stimulated, according to some embodiments. The subterranean formation 114 is penetrated by wellbore 112 from a surface wellsite 110. The formation 114 has a plurality of zones that are to be independently stimulated, such as zones 120, 122, 124, 126 and 128. Within well bore 112 is a casing (or production tubing) 130 that has multiple sliding casing valves 140, 142, 144, 146 and 148 that are positioned so as to be aligned with zones 120, 122, 124, 126 and 128, respectively. The casing 130, according to some embodiments, is cemented in place within wellbore 112.

Each of the sliding casing valves 140, 142, 144, 146 and 148 are equipped with a rocking sleeve mechanism, which will be described more fully, infra. According to some embodiments, a specifically dimensioned dart is dropped and/or pumped down the inner conduit of casing 130 so as to selectively target actuation of a specific sliding casing valve. The dart actuates the targeted sliding casing valve by interacting with the rocking sleeve mechanism such that it is "caught" by the rocking sleeve and fluid pressure forces the sliding valve to open. Although five zones and five sliding casing valves are shown in FIG. 1 for purposes of clarity, in many applications there are other numbers of zones and valves. For example, it is not uncommon for 20 or more zones that are to be stimulated using 20 or more sliding valves.

Figure 2A:
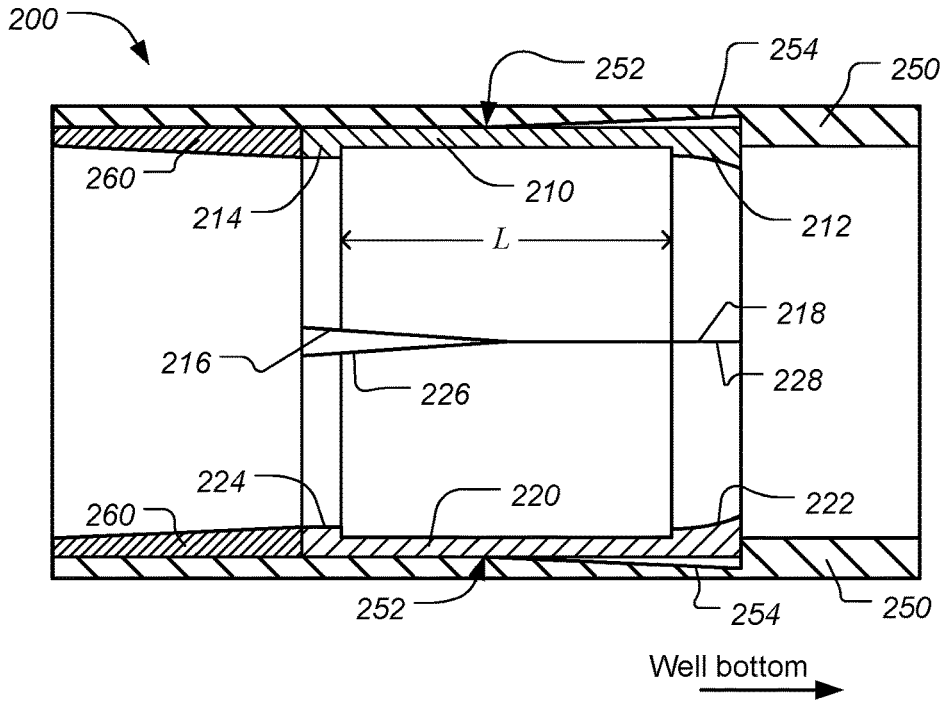
FIGS. 2A and 2B are sectional views of a segmented rocking sleeve as it is placed inside the sliding valve sleeve, according to some embodiments.
Figure 2B:
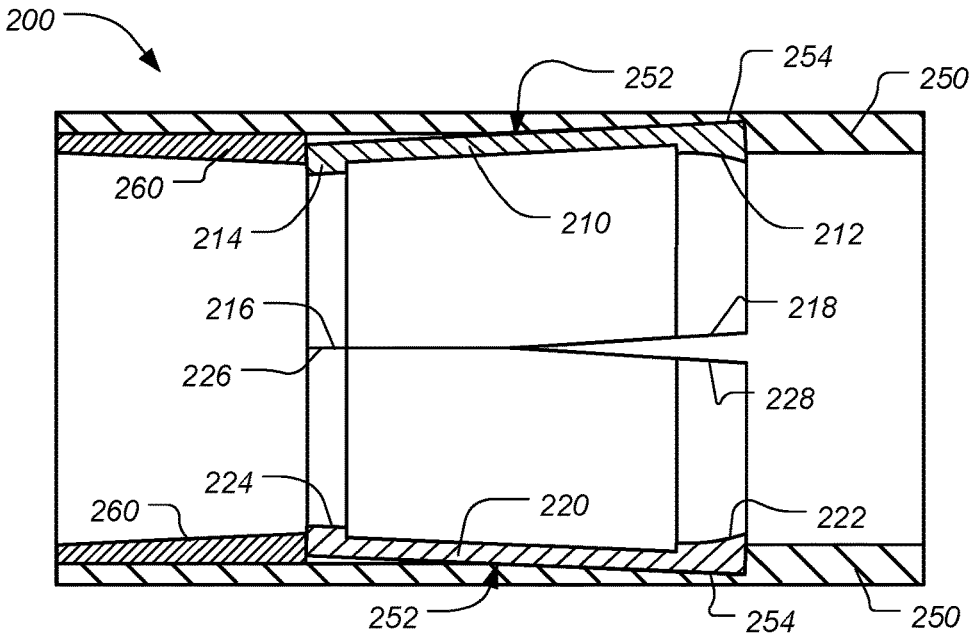

FIGS. 2A and 2B are sectional views of a segmented rocking sleeve as it is placed inside the sliding valve sleeve, according to some embodiments. Rocking sleeve assembly 200 is shown that forms part of a sliding casing valve, such as valves 140, 142, 144, 146 and 148 shown in FIG. 1. FIG. 2A shows the rocking sleeve assembly 200 with the segments closed at the bottom end (i.e. further to the right side). This is the "normal" configuration, meaning that the sleeve is in this position when not engaged by a dart. This is also the position of the rocking sections when a dart is not being allowed to pass. The sleeve assembly 200 is made up of an outer sleeve 250 that has a flared indentation 254 beginning at a location 252, which acts as a fulcrum on which the rocking segments pivot. A plurality of rocking segments are disposed within the outer sleeve 250 of which two, 210 and 220, are visible in FIGS. 2A and 2B. In FIG. 2A the bottom surfaces 218 and 228 of rocking sections 210 and 220 respectively are in contact with each other as shown. The upper surfaces 216 and 226 of rocking sections 210 and 220 respectively are not in contact with each other. The upper end of each rocking section 210 and 220 includes a protruding portion, 214 and 224, respectively. The bottom end of each rocking section 210 and 220 also includes a protruding portion 212 and 222, respectively. A ramp member 260 ensures a smooth transition to the upper protruding portions 214 of section 210 and 224 of section 220. FIG. 2B shows the rocking sleeve assembly 200 with the segments 210 and 220 closed at the top end. Is can be seen that the upper surfaces 216 and 226 are in contact while the lower surfaces 218 and 228 are not. The outer surfaces of the rocking portions 210 and 220 fit into the indentation 254 as shown. In the configuration shown in FIG. 2B the sleeve will allow the passage of darts having a characteristic length that is shorter than the target length of the sleeve.

Although two rocking sections 210 and 220 are visible in FIGS. 2A and 2B, in general there can be two or greater numbers of rocking sections, such as two, three, four, five or six rocking sections. Each of the rocking sections exhibits a rocking (or pivoting) function between its front (uphole) end and its back (downhole) end. The space between the upper and lower protrusions give the rocking sections a characteristic length "L" that is also referred to as the "target length" of the sleeve. The rocking function allows darts having a shorter characteristic length than the "target length" of the sleeve to pass through the sleeve.

Figure 3:
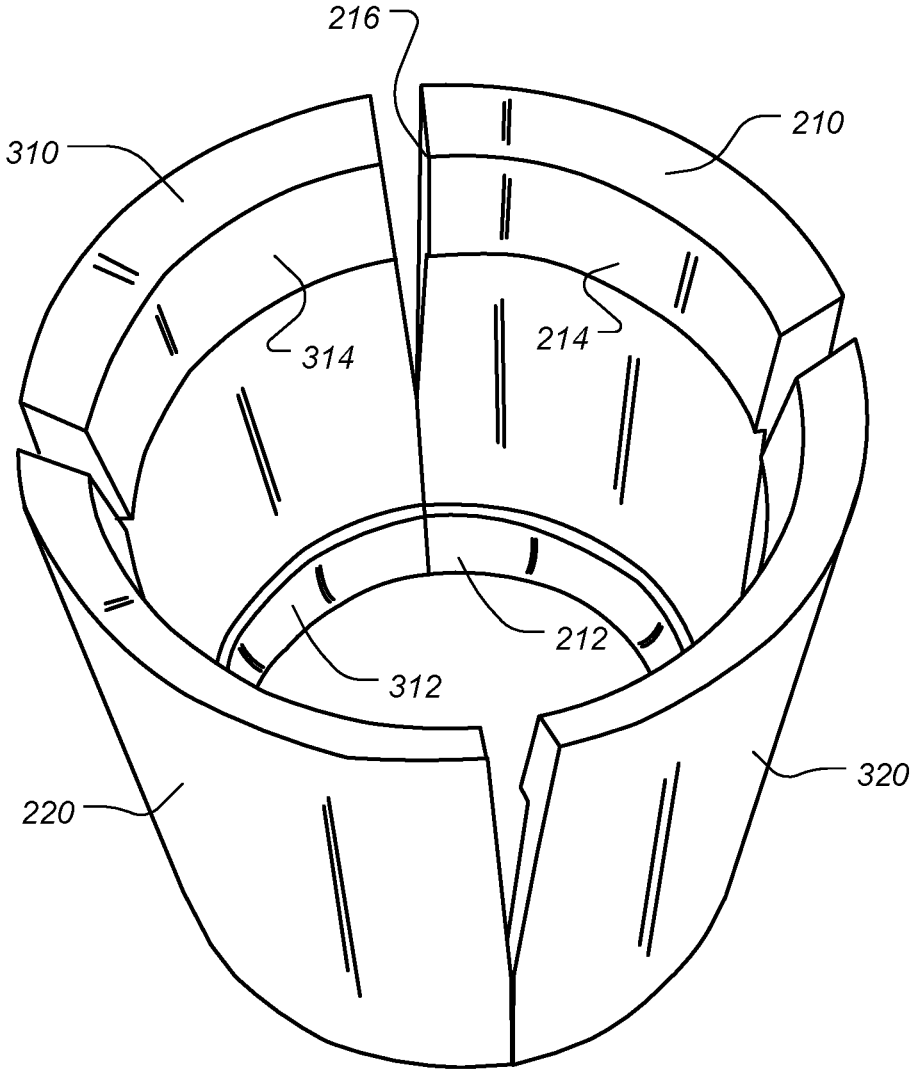
FIG. 3 is a perspective view of a set of rocking sections used as part of a rocking sleeve assembly, according to some embodiments.

FIG. 3 is a perspective view of a set of rocking sections used as part of a rocking sleeve assembly, according to some embodiments. In the example shown, the rocking portion of the sleeve is segmented into four circumferential rocking sections, each spanning a 90 degree angle. Other numbers of rocking sections can be used including 2, 3, 5, 6 or more sections. The rocking sections 210, 310, 220 and 320 are dimensioned so as to fit into an appropriately shaped portion of the casing (or production tubing), such as into indentation 254 of sleeve 250 shown in FIG. 2. The casing (or tubing) is shaped to constrain the axial position of the rocking portions and to allow the segments to rock (or pivot) around an axis near the mid-length location of the sleeve (for example location 252 on sleeve 250 shown in FIG. 2). Also visible in FIG. 3 are the upper protrusions 214 and 314 of rocking sections 210 and 310, upper surface 216 of rocking section 210, and lower protrusions 212 and 312 of sections 210 and 310. Note that the rocking sections are positioned in FIG. 3 in the "normal" position, where the sleeve is either not being engaged by a dart, or not allowing a dart to pass. As can be seen, the bottom end surfaces of sections are in contact with each other. As can be seen, when the rocking sections are in this position, a relatively good fluid seal can be formed by the bottom end surfaces of sections being in contact with each other, and the lower protrusions of each rocking section mating with an appropriately shaped dart that is being "trapped" by the rocking sleeve. The fluid sealing characteristic is advantageous in providing zonal isolation and also for providing sufficient fluid pressure to actuate the sliding valve mechanism. As discussed, supra, although four rocking sections are shown in FIG. 3, other numbers of rocking sections can be used provided there are at least two rocking sections. When selecting the number of rocking sections to used for a particular application, consideration should be given to the requisite strength and bending stiffness of the sleeve segments and the material used. For example, in some cases two rocking sections are used which provides greater strength and bending stiffness. In such cases the ends of the protruding portions 212 and 222 (e.g. shown in FIGS. 2A and 2B) should be appropriately "flared" so that when the rocking sections pivot to open up at the bottom end (such as shown in FIG. 2B), the dart can pass through. This flare shaping becomes more important when fewer numbers of rocking sections are used.

FIGS. 4A-4E are a sequence of snapshot sectional views illustrating the rocking actions of a sleeve assembly as a dart is being allowed to pass, according to some embodiments. The dart 410 is able to pass through the rocking sleeve assembly 200 since the characteristic length "l" is shorter than the target length "L" of the sleeve assembly. The shape of solid dart 410 can be thought of as three sections, although it may be manufactured from a single solid piece of material. The front section 412 in the example shown is semispherical and this shape should be matched to the "seat" formed by the bottom end protrusions of the sleeve sections (e.g. 212 and 222 in FIGS. 2A-2B and 212 and 312 in FIG. 3). The middle section 414 is preferentially cylindrical (or with cylindrical sub-sections at the ends, with some appropriately smooth shape in between). According to some embodiments, the length of the middle section determines the characteristic length l of the dart. The back section 416 is preferentially conical, or exhibiting an appropriate tapering towards the back end so as to allow the rocking segments to rock (without being constrained by the back of the dart) in cases where the dart is being allowed to pass through the sleeve. In particular, the back section 416 should be shaped such that it will clear the upper protrusions (e.g. 214 and 224 of sections 210 and 220 shown in FIG. 2) of the rocking sections in cases where characteristic length l is equal to or shorter than the target length L of the sleeve. Note that while the front section of dart 412 is shown to be semispherical, in general other shapes can be used. In general any revolved surface (i.e. surface of revolution) can be used for the front section 412 and this shape should be matched to the seat formed by the bottom end protrusions of the rocking sections. For example, according to some embodiments, the front of the dart is conical and the seat formed by the bottom end protrusions of the rocking sections is a matching conical shape.

Figure 4A:
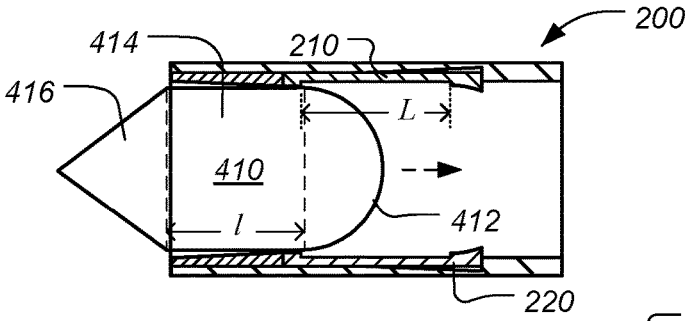
FIGS. 4A-4E are a sequence of snapshot sectional views illustrating the rocking actions of a sleeve assembly as a dart is being allowed to pass, according to some embodiments.
Figure 4B:
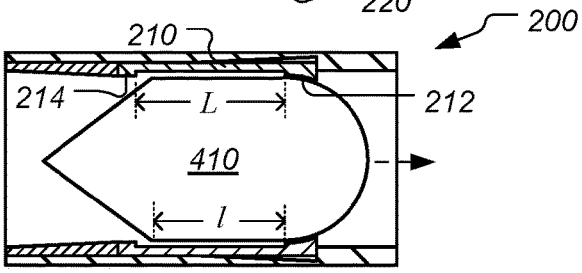
Figure 4C:
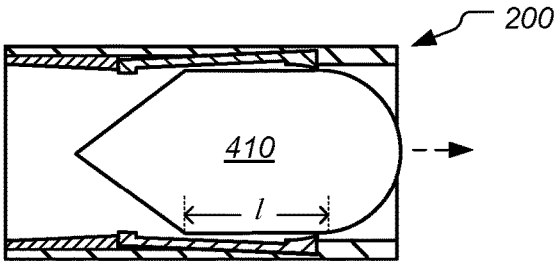
Figure 4D:
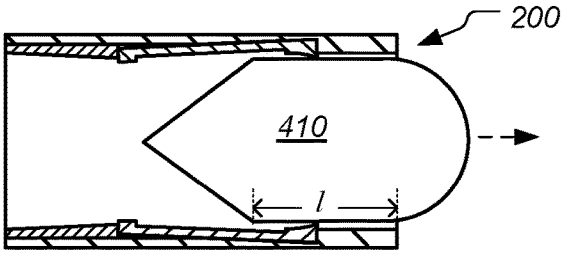
Figure 4E:
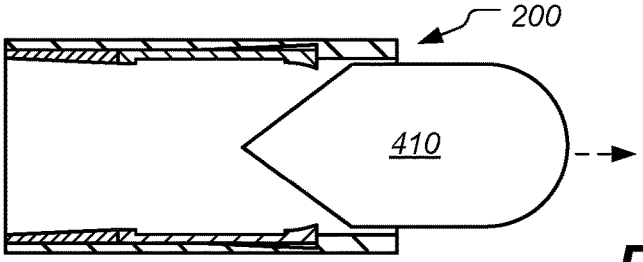

In FIGS. 4B-4C, it can be seen that as the front of the dart 410 reaches the bottom seat of the rocking sections (e.g. bottom protrusion 212 of section 210) of the sleeve assembly 200, the dart 410 pushes the rocking sections radially outwards. This rocking action of the rocking sections causes the top protrusions of the rocking sections (e.g. protrusion 214 of section 210) to move radially inwards in cases where the top protrusions are not blocked by the dart (which in this case is due to the dart length 1 being equal to or shorter than the sleeve target length L). As can be seen from FIG. 4D, once the bottom seat opens, the dart can pass through. In FIG. 4E it can be seen that the rocking sections return to the "normal" position in which the bottom end seat (e.g. protrusion 212 of section 210) are pushed back radially inwards. According to some embodiments a spring can optionally be provided (not shown) which can be used to keep the sleeve segments in a normally closed position such as shown in FIG. 4E, if desired.

As mentioned, the shape of the bottom protrusions (e.g. 212 and 222 in FIGS. 2A, 2B, 4A-E, and 212 and 312 in FIG. 3) can be conical, spherical or the shape of some other surface of revolution that forms a segmented "seat" at the bottom end of the sleeve assembly. This seat mates with the shape of the front section 412 of the dart. By matching the seat geometry with the geometry of the front of the dart, sufficient fluid isolation can be provided between the sections of the well above and below the sleeve.

Figure 5A:
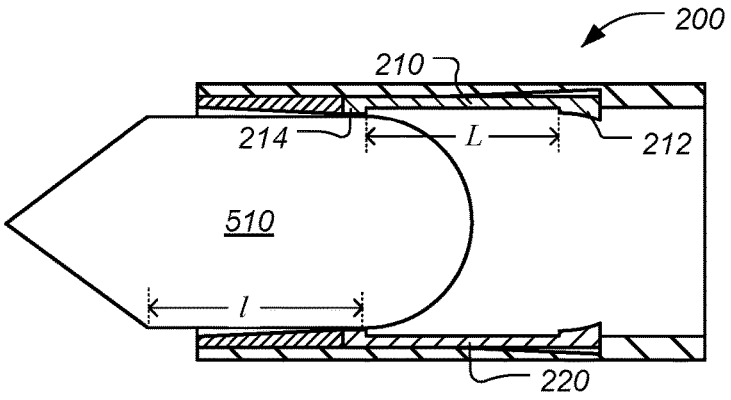
FIGS. 5A-5C are a sequence of snapshot sectional views illustrating the case when a dart is caught by a rocking sleeve assembly, according to some embodiments.
Figure 5B:
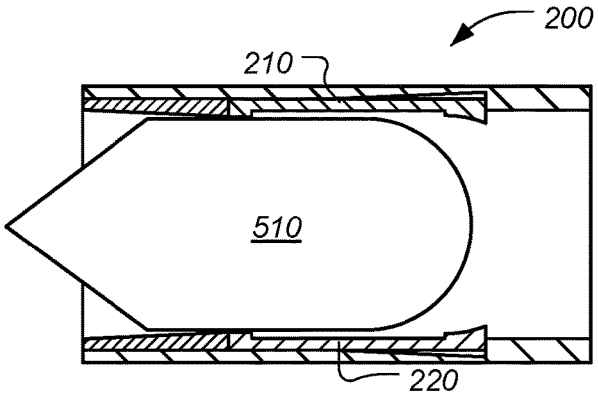
Figure 5C:
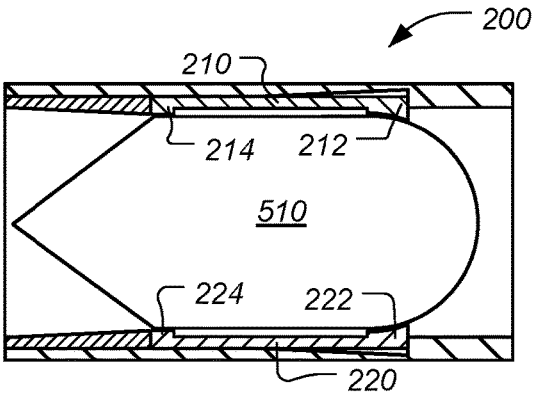

FIGS. 5A-5C are a sequence of snapshot sectional views illustrating the case when a dart is caught by a rocking sleeve assembly, according to some embodiments. The dart 510 has a characteristic length l, that is determined by the length of the cylindrical middle part of the dart. The sleeve assembly 200 has rocking sections (of which 210 and 220 are visible) with a target length of L, as measured between the bottom and top protrusions (e.g. 212 and 214 of section 210). In this case, l>L. In FIG. 5C, it can be seen that as the front of the dart 510 reaches the bottom seat formed by the bottom protrusions (212 and 224), the front of the dart tries to push the rocking sections radially outwards. However, the rocking sections are unable to rock because the upper protrusions (214 and 224) are pressed against the back of the dart 510. Consequently, the dart 510 is not allowed to pass through. The dart 510 remains anchored in place as shown in FIG. 5C. A seal is formed by the contact of the rocking sections with each other, and with the front of the dart 510 seated in the bottom protrusions of the rocking section. This seal prevents any fluid (or can allow an acceptable minimal amount of fluid) being pumped into the well to flow pass the dart 510, and therefore isolate the lower section of the well below the dart.

Figure 6A:
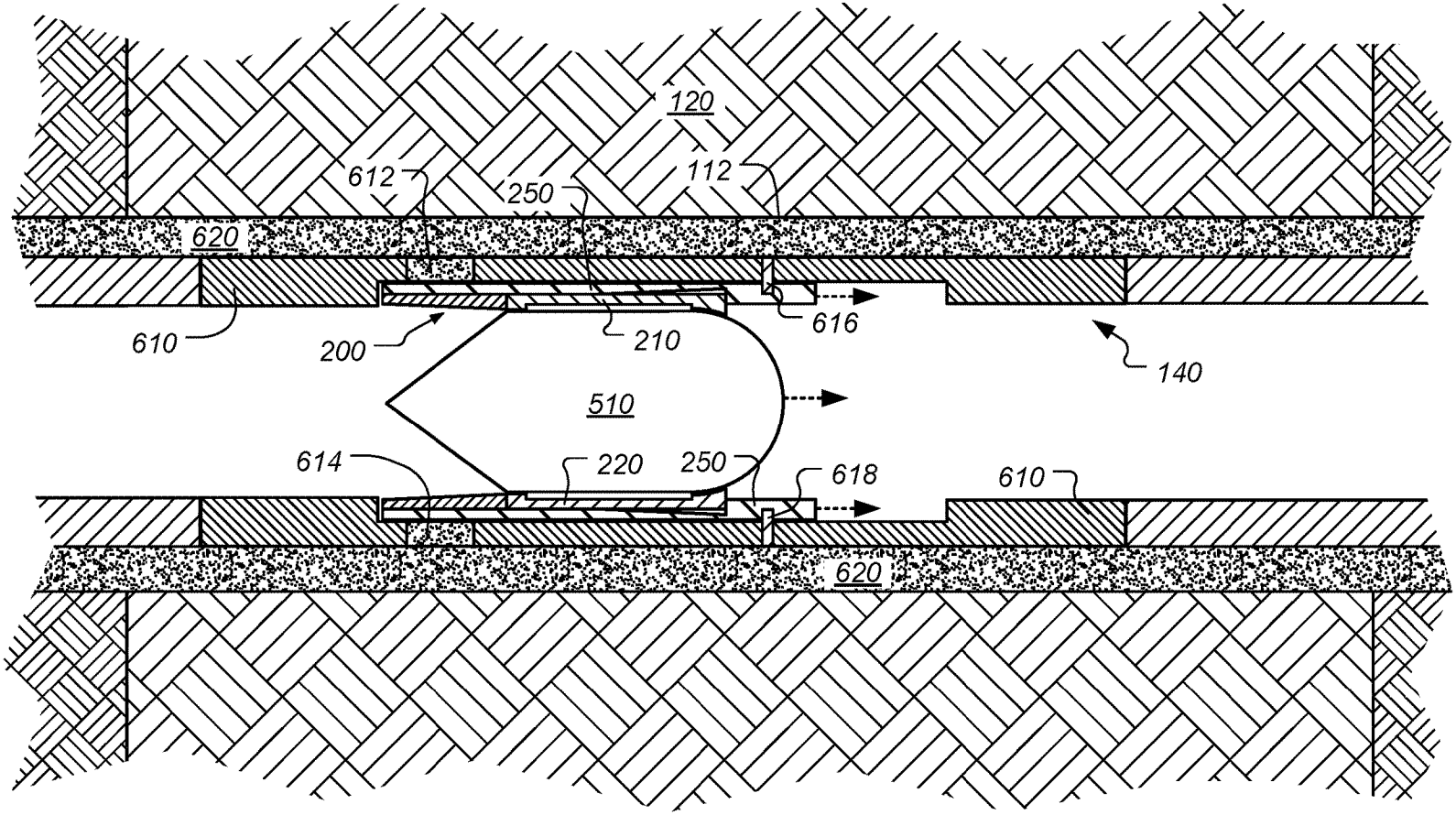
FIGS. 6A and 6B are axial sectional views of a dart and rocking sleeve assembly forming part of a sliding valve positioned inside a casing, according to some embodiments.
Figure 6B:
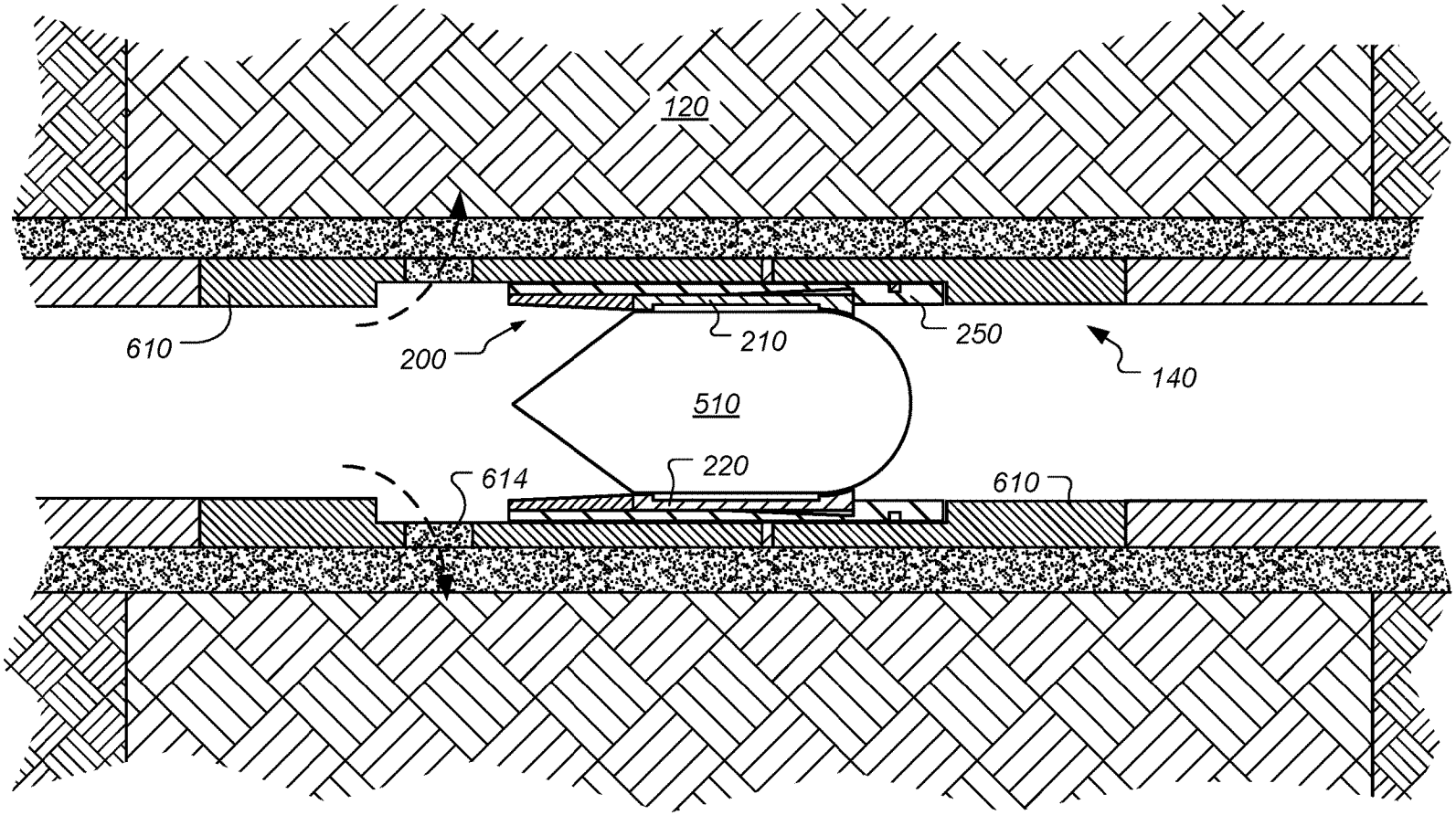

FIGS. 6A and 6B are axial sectional views of a dart and rocking sleeve assembly forming part of a sliding valve positioned inside a casing, according to some embodiments. Sliding casing valve 140 is shown positioned in zone 120 of the subterranean rock formation. In this case the valve 140 is cemented with cement 620 in place within the wellbore 112. Sliding casing valve 140 includes sleeve assembly 200 mounted within recessed location a valve housing 610 such that it can slide axially. FIG. 6A shows sleeve assembly 200 in its initial configuration, which according to some embodiments is as it was conveyed downhole. The sleeve assembly 200 covers a plurality of fracturing ports in the casing, of which 612 and 614 are visible in FIGS. 6A and 6B. A plurality of shear pins, of which pins 616 and 618 are visible in FIG. 6A, keep the shifting sleeve assembly 200 in place. Dart 510 is shown and is not allowed to pass through sleeve assembly 200, since dart 510 has a characteristic length l that is equal to or greater than the target length L of the sleeve assembly 200, such as shown in FIGS. 5A-5C. FIG. 6B shows the sleeve assembly 200 shifted towards the well bottom typically by the pressure differential between the top and bottom of the dart. The shear pins are designed to fail by shearing action under an appropriately chosen axial load on the sleeve, and allow the sleeve assembly 200 to shift downwards. The fracturing ports are now exposed to the inner fluid in the casing. Accordingly, when the valve 140 is in the open position, as shown in FIG. 6B, fracturing fluid can flow into the rock as shown by the dashed arrows.

Figure 7:
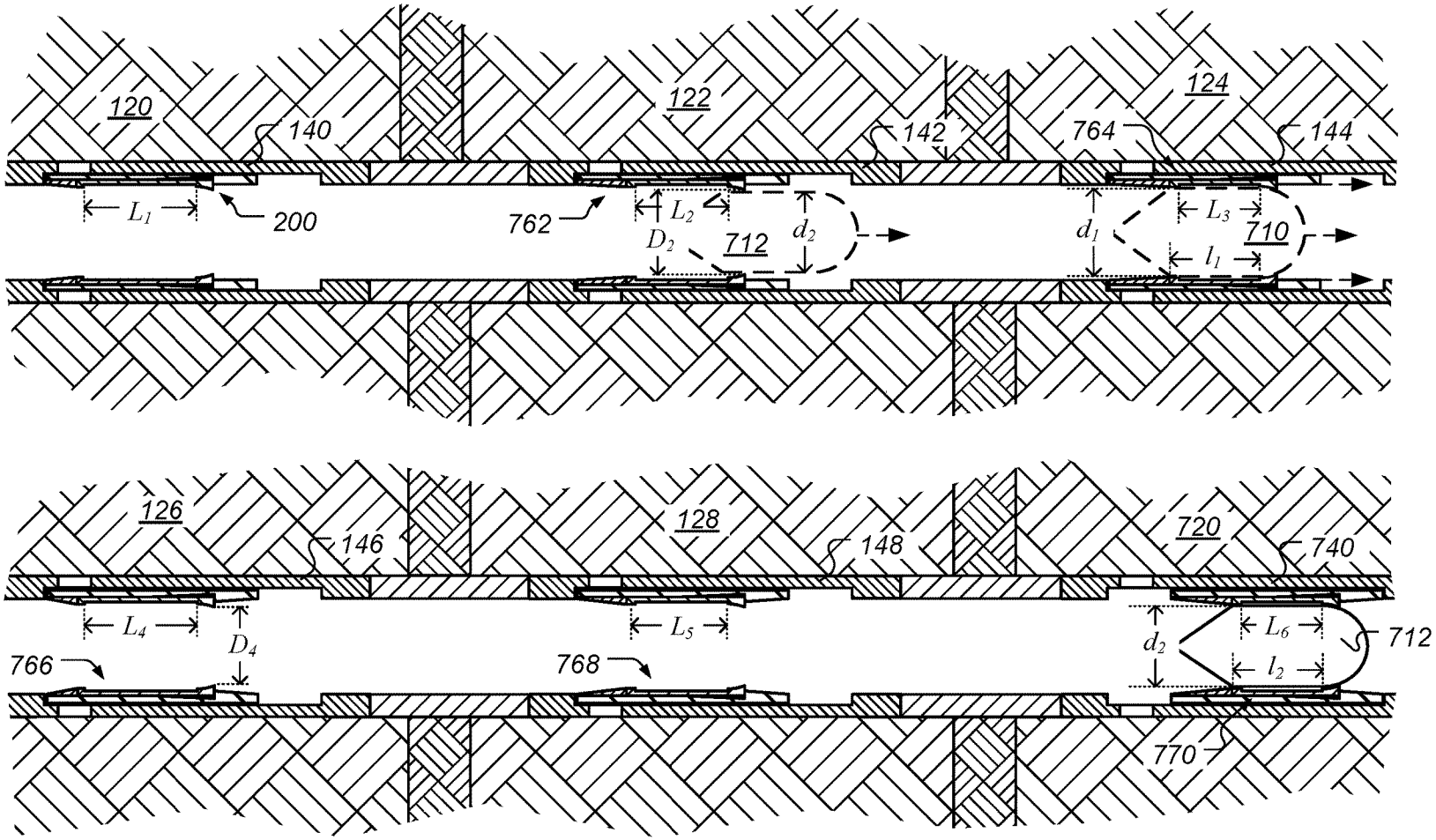
FIG. 7 is a cross sectional diagram showing a plurality of zones of a formation and a plurality of casing valves having rocking sleeve functionality, according to some embodiments.

FIG. 7 is a cross sectional diagram showing a plurality of zones of a formation and a plurality of casing valves having rocking sleeve functionality, according to some embodiments. Zones 120, 122, 124, 126, 128 and 720 can be independently isolated and stimulated using sliding casing valves 140, 142, 144, 146, 148 and 740, which are equipped with sleeve assemblies 200, 762, 764, 766, 768 and 770, respectively. Each of the sleeve assemblies has a target length L as well as a characteristic diameter "D" which is a minimum diameter between protrusions of the sleeve assembly, which is also equal to the minimum diameter that a dart has to be trapped by the sleeve, assuming its characteristic length l is greater than or equal to the target length L of the sleeve assembly. In the example of FIG. 7, sleeve assemblies 200, 762, 764, 766, 768 and 770 have characteristic diameters $D_1$, $D_2$, $D_3$, $D_4$, $D_5$ and $D_6$, and target lengths $L_1$, $L_2$, $L_3$, $L_4$, $L_5$ and $L_6$, respectively. According to some embodiments, by using both, dart length and dart diameter, rather than having a one-dimensional sequence of increasing radii (as in the known ball-restriction technique), a two-dimensional set of possible configurations is provided. This greatly enhances the number of stages that could be isolated in a multi-stage fracturing operation; particularly because in contrast with the radial dimension, which is constrained by the well diameter, there is much more freedom along the axial direction. In the example of FIG. 7, the first three sleeve assemblies 200, 762, 764 all have equal diameters, which are all greater than the diameters of the last three sleeve assemblies 766, 768 and 770. In other words: $D_1=D_2=D_3>D_4=D_5=D_6$. Note that only $D_2$ and $D_4$ are labeled in FIG. 7 for clarity. Further the target length of each of the first three sleeve assemblies is shorter than the previous such that $L_1>L_2>L_3$. Similarly, the target length of each of the last three sleeve assemblies is shorter than the previous such that $L_4>L_5>L_6$. In an example, a dart 712 having diameter $d_2$, characteristic length $l_2$, passes through all the sleeve assemblies 200, 762, 764, 766 and 768, and is only trapped by sleeve assembly 770. Because $d_2<D_1$, $D_2$ and $D_3$, dart 712 passes through sleeve assemblies 200, 762 and 764. Because $l_2<L_4$ and $L_5$, dart 712 passes through sleeve assemblies 766 and 768. But dart 712 is trapped by sleeve assembly 770 because $l_2\geq L_6$, and $d_2\geq D_6$. Similarly, despite $d_2\geq D_1$, $D_2$ and $D_3$, dart 710 passed through assemblies 200 and 762 since $l_1<L_1$ and $L_2$, and is trapped by assembly 764 since $l_1\geq L_3$.

According to some embodiments the darts, either entirely or partially (e.g. appropriate sections of it), are made of dissolvable materials. This will facilitate the operation of opening the well for production after the fracturing operation has taken place.

According to some embodiments, the dart and sleeve mechanism described herein can be used for many other downhole applications whenever there is a need to selectively activate a series of actuations of devices (e.g. valves, packer, and etc.).

The techniques described, according to some embodiments, have advantages over techniques such as described in US 2015/0000935 that uses movable dart pieces. A single solid dart that has no moving parts is more structurally robust. As a result, designers have greater freedom in selecting dart material. This is important when darts are made from a dissolvable material. The techniques described herein also do not rely on control lines on the outside of the completion.

The techniques described, according to some embodiments, also have advantages over techniques such as described in US 2014/0299319 that use rocking members on a sleeve combined with a plurality of casing ribs. In this known technique, the sleeve assembly becomes longer with each additional zone by the rib-to-rib spacing amount. In contrast, in the techniques described herein, the sleeve assembly becomes longer for each additional zone by a much smaller amount (e.g. the width of the upper protrusions 214 and 224 in FIGS. 2A and 2B). Furthermore, the rocking sections can be configured to form a better seal with the dart since the rocking section bottom surfaces can meet each other such as shown in FIG. 3.

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for selectively actuating a plurality of devices positioned in a well, comprising:

a conduit configured for positioning within the well;

the plurality of devices disposed along the conduit such that a fluid passageway extends through each of the devices;

a plurality of assemblies forming part of the devices such that each device includes at least one assembly, each assembly of the plurality of assemblies comprising:

an assembly outer sleeve having on its inner surface a fulcrum and an indentation; and a plurality of rocking sleeve members circumferentially arranged within the outer sleeve such that the passageway extends through the rocking sleeve members and axial movement of the rocking sleeve members is constrained, each rocking sleeve member having an outer surface dimensioned and shaped to pivot on the fulcrum and to partially fit into the indentation when rocked toward the indentation; and a plurality of untethered objects configured to be communicated through the passageway, each shaped and dimensioned such that it can either pass or be trapped by said at least one assembly, the object being trapped by an assembly when a characteristic length and a characteristic diameter of the object prevent sufficient rocking action by the rocking sleeve members that would allow the object to pass through the at least one assembly, said devices configured for actuation when the object is trapped by an included assembly, the actuation at least in part caused by a fluid pressure differential on either side of the trapped object; and wherein each rocking sleeve member has first and second inwardly protruding portions, the characteristic length for each object is a length of a portion of object that has a maximum diameter, and the object can be trapped by the at least one assembly when its characteristic length is at least as long as a distance between the first and second inwardly protruding portions of the rocking sleeves of the at least one assembly.

2. The system according to claim 1, wherein each untethered object is a solid dart having a front portion shaped as a surface of revolution, a cylindrical middle portion and tapered rear section, the second inwardly protruding portions of the rocking sleeve members being shaped to match the shape of the front portions, and the characteristic length for each dart is equal to a length of the cylindrical middle portion of each dart.

3. The system according to claim 2, wherein when said solid dart is trapped by said at least one assembly, engagement of the surface of revolution shaped front portion of the dart with the second inwardly protruding portions of the rocking sleeve members forms a seal that facilitates the fluid pressure differential.

4. The system according to claim 2, wherein the front portion of the solid dart has a shape selected from a group consisting of: semispherical and conical.

5. The system according to claim 1, wherein said conduit is a casing and said devices are sliding casing valves each including an outer sleeve having at least one opening and an inner sleeve, the inner and outer sleeves forming a valve between the fluid pathway and an annular region outside of the casing, and the valve being open when the at least one opening of the outer sleeve is not obstructed by the inner sleeve due to sliding of the inner sleeve relative to the outer sleeve.

6. The system according to claim 5, wherein the well penetrates a subterranean rock formation having a plurality of zones to be stimulated, the casing valves are normally closed, and the casing valves are positionable in the well with at least one casing valve in each zone such that each zone can be selectively stimulated by communicating the object that is configured to be trapped by said at least one assembly of the casing valve in the zone and the fluid pressure differential causes the inner sleeve to slide relative to the outer sleeve so as to open the valve.

7. The system according to claim 6, wherein the subterranean rock formation is a hydrocarbon-bearing formation.

8. The system according to claim 5, further comprising:

one or more shear pins configured to engage both the inner and outer sleeves so as to inhibit unintentional opening of the casing valve.

9. The system according to claim 5, wherein each untethered object is a dart made of a degradable material which is configured to dissolve in the wellbore environment after having been used to selectively actuate a device.

10. The system according to claim 1, wherein each assembly includes at least three similarly shaped circumferential rocking sections.

11. The system according to claim 1, wherein the plurality of rocking sleeves included in each assembly has a characteristic diameter and the object can be trapped by the at least one assembly when the characteristic diameter of the object is at least as large as the characteristic diameter of the rocking sleeves of the assembly.

12. A method of selectively actuating devices in a well, comprising:

installing a conduit in the well having a plurality of devices disposed thereon such that a fluid passage way extends through the conduit and through each device, each device of the plurality of devices including one or more assemblies, each assembly including an outer sleeve having on its inner surface a fulcrum and an indentation, and a plurality of rocking sleeve members circumferentially arranged within the outer sleeve such that the fluid passage extends therethrough, and each sleeve member having an outer surface dimensioned and shaped to pivot on the fulcrum and to partially fit into the indentation when rocked toward the indentation;

selecting and pumping an untethered object through the passageway, the object shaped and dimensioned to pass through certain assemblies and to be trapped by a target assembly that has sleeve members that are prevented from rocking by the object due to a characteristic length and a characteristic diameter of the object;

trapping the object by the target assembly which is included in a target device;

actuating the target device at least in part using force from a fluid pressure differential created by the object being trapped in the assembly; and wherein each rocking sleeve member has first and second inwardly protruding portions, the characteristic length for each object is a length of a portion of the object that has a maximum diameter, and the object can be trapped by the assembly when its characteristic length is at least as long as a distance between the first and second inwardly protruding portions of the rocking sleeves of the assembly.

13. The method according to claim 12, wherein each untethered object is a solid dart having a front portion shaped as a surface of revolution, a cylindrical middle portion and tapered rear section, the second inwardly protruding portions of the rocking sleeve members being shaped to match the shape of the front portions, and the characteristic length for each dart is equal to a length of the cylindrical middle portion of each dart.

14. The method according to claim 12, wherein said conduit is a casing and said devices are sliding casing valves each including an outer sleeve having at least one opening and an inner sleeve having at least one opening, the inner and outer sleeves forming a valve between the fluid pathway and an annular region outside of the casing, and said actuating the target device involved opening the valve by sliding the inner sleeve relative to the outer sleeve so as to align the at least one opening on the outer sleeve with the at least one opening on the inner sleeve.

15. The method according to claim 14, wherein the well penetrates a subterranean rock formation having a plurality of zones to be stimulated, the casing valves are normally closed, the casing valves are positioned in the well with at least one casing valve in each zone, the target assembly and the target device are within a target zone to be stimulated, and the method further comprises stimulating the target zone by increasing fluid pressure in the conduit and the target zone.

16. The method according to claim 15, further comprising:

pumping a second untethered object through the passageway, the object selected to be trapped by a second target assembly in a second target valve positioned in a second target zone;

trapping the second object by the second target assembly;

actuating the second target valve; and stimulating the second zone.

* * * * *